United States Patent [19]

Lin

[11] Patent Number: 4,979,767

[45] Date of Patent: Dec. 25, 1990

[54] OPENING DEVICE FOR A DOUBLE LOCK

[75] Inventor: Jui C. Lin, Kaohsiung Hsien, Taiwan

[73] Assignee: Taiwan Fu Hsing Industry Co., Ltd., Kaohsiung Hsien, Taiwan

[21] Appl. No.: 462,087

[22] Filed: Jan. 8, 1990

[51] Int. Cl.[5] ..... E05B 63/14

[52] U.S. Cl. ..... 292/336.3; 70/107

[58] Field of Search ..... 70/107, 118, 481; 292/39, 37, 36, 336.3

[56] References Cited

U.S. PATENT DOCUMENTS

| | | | |
|---|---|---|---|
| 3,910,613 | 10/1975 | Nolin | 70/107 |
| 3,999,789 | 12/1976 | Maurits et al. | 292/36 |
| 4,129,019 | 12/1978 | Urdal | 70/107 |
| 4,183,563 | 1/1980 | Stevens | 70/107 |
| 4,418,552 | 12/1983 | Nolin | 70/107 |
| 4,709,565 | 12/1987 | Lin | 70/107 |
| 4,809,526 | 3/1989 | Shen | 70/107 |
| 4,838,053 | 6/1989 | Shen | 70/107 |

*Primary Examiner*—Eric K. Nicholson

*Attorney, Agent, or Firm*—Fleit, Jacobson, Cohn, Price, Holman & Stern

[57] ABSTRACT

A united opening device for a double lock comprising a cam disc respectively on the shafts of a main lock and an auxiliary lock, and an intermediate plate which interacts with the two cam discs, able to unlock the auxiliary lock at the same time when the main lock is rotated to unlock after both locks have been locked.

3 Claims, 3 Drawing Sheets

OPENING DEVICE FOR A DOUBLE LOCK

BACKGROUND OF THE INVENTION

The applicant of the present invention has acquired an United States Letter Pat. No. 4,709,565, titled "United Opening device for a double-locked door", which has been found to have the following shortcoming.

The main disc 4 connected with the main lock is provided with two projecting rings 42 on its two sides. Said rings 42 always keep in touch with the two hooks in the linking plate 1 so that said rings 42 are to be pressed once and to produce striking noise when the main disc 4 rotates. Besides, the spring 6 gradually loses elasticity pulling the main disc after a long period of use, which results in high malfunction.

SUMMARY OF THE INVENTION

In view of the defects mentioned above, the object of this invention is to provide an improved structure.

This invention comprises an intermediate plate, a linking plate, a limit plate, a surface plate, a bottom plate, a main cam disc and an auxiliary cam disc as its main parts.

The intermediate plate is set between the surface plate and the bottom plate, and the linking plate and the limit plate are set between the intermediate plate and the surface plate. The main lock and the auxiliary lock have their shafts pass through the shaft holes in the intermediate plate, the surface plate and the bottom plate.

The linking plate has two bent hooks respectively at the top and the bottom. The auxiliary lock shaft has a cam disc positioned between the surface plate and the linking plate and the main lock shaft also has a cam disc between the same plates. The linking plate, normally staying at the lower section of the intermediate plate, can be moved up and down in the limited distance by interaction of both cam discs and the hooks.

When this device is not in use for opening the door, the main lock shaft does not contact with the linking plate when it rotates, as the main cam disc cannot go to activate the linking plate.

When both locks are in locked condition, the linking plate is in the moved-up position, having its lower hooks in contact with the main cam disc. Then if the main lock is rotated to unlock, the main cam disc rotates to pull down the linking plate, to the result that the auxiliary lock is also to be unlocked by interaction of the auxiliary cam disc and the upper hooks of the linking plate.

BRIEF DESCRIPTION OF THE DRAWINGS

This invention will now be described in detail with reference to accompanying drawings wherein.

DETAILED DESCRIPTION OF THE INVENTION

Figure 1:
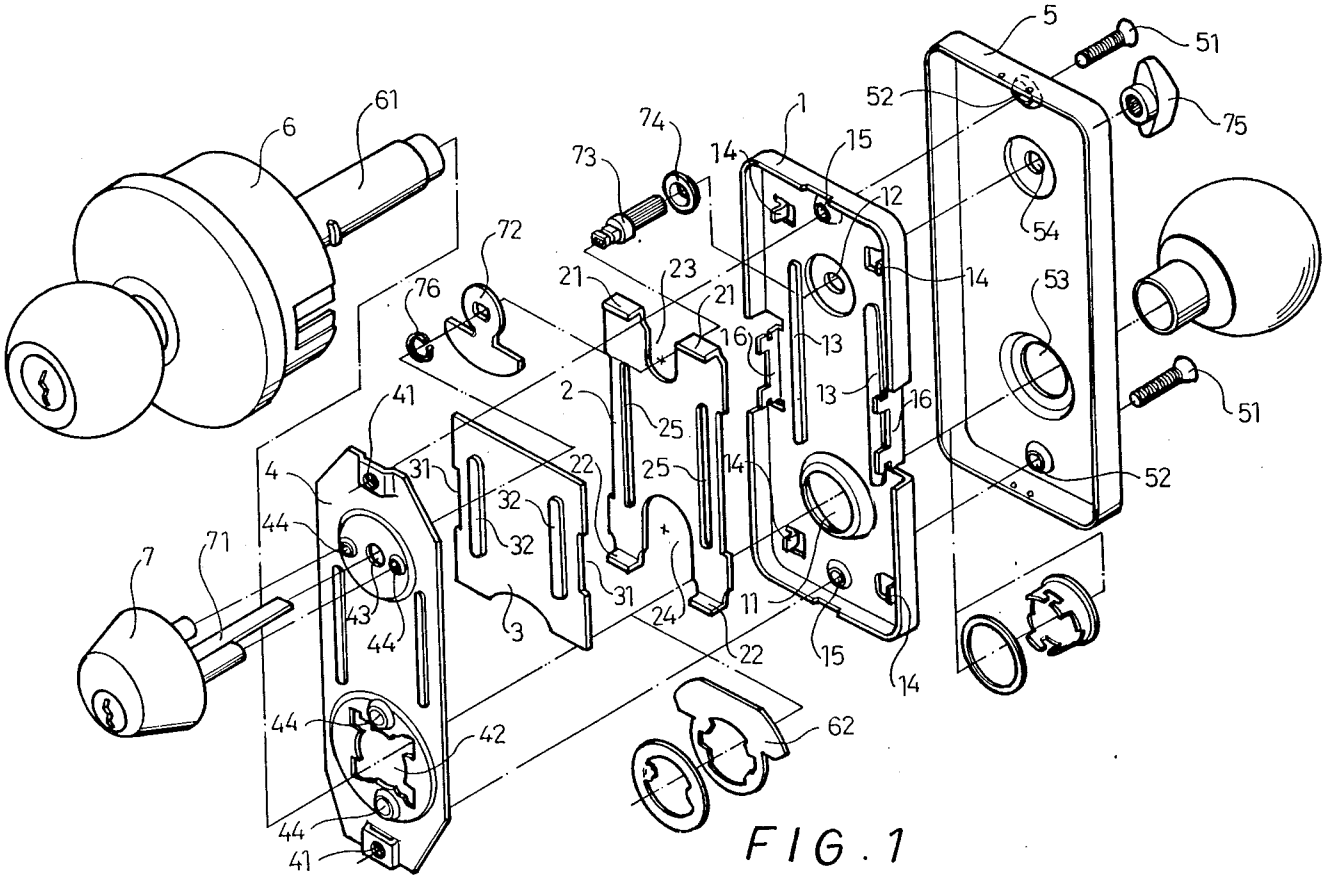
FIG. 1 is an exploded perspective view of the united opening device for a double lock in accordance with the present invention.

This invention comprises intermediate plate 1, linking plate 2, limit plate 3, surface plate 4, bottom plate 5, main cam disc 62 and auxiliary cam disc 72 as important parts.

Referring to FIG. 1, intermediate plate 1 is provided with main lock shaft hole 11 and auxiliary lock shaft hole 12 for the shafts 61 and 71 of main lock 6 and auxiliary lock 7 to run through, two projecting parallel rails 13 for linking plate 2 to rest on with less contacting dimention with intermediate plate 1, when linking plate 2 moves in relation to intermediate plate 1, four projecting feet 14, two at the upper and two at the lower for restricting vertical movement of linking plate 2, two holes for bolts 51 to pass through, and a hook base 15 respectively at the right and left sides being slidable in and engagable with grooves 31 in limit plate 3.

Linking plate 2 made of metal is contained in intermediate plate 1, resting on rails 13 therein, and has a straight recess in the right and the left sides for hook base 15 to stick therein. To enable linking plate 2 to move vertically in intermediate plate 1, linking plate 2 has upper cutout opening 23 and lower cutout opening 24 to avoid hampering by main and auxiliary lock shafts in vertical movement of linking plate 2. Besides, linking plate 2 has two parallel projecting rails 25 to smooth mutual contact with limit plate 3 and to reinforce said plate 2.

Next, limit plate 3 is provided with a straight recess 31 respectively at the right and left sides for hook base 16 of intermediate plate 1 to engage therein to fix limit plate 3 securely, and thereby linking plate 2 is confined to move between intermediate plate 1 and limit plate 3. Besides, limit plate 3 is also provided with two parallel reinforcing rails 32 projecting inwardly.

Surface plate 4 has threaded holes 41 for bolts 51 to screw with for combining surface plate 4 with intermediate plate 1, main lock shaft hole 42 and auxiliary lock shaft hole 43 for main and auxiliary lock shafts to run through, positioning holes 44 near the peripheries of said holes 42 and 43 for fixing the outsides of main and auxiliary locks 6 and 7. And before assembling surface plate 4 and intermediate plate 1 together, main cam disc 62 and auxiliary cam disc 72 are to be set between both plates 4 and 1 in advance.

Bottom plate 5 is to be fixed on the inside of a door for covering intermediate plate 1 and so on, provided with two holes 52 for bolts 51 to fix said plate 1 and so on, and main lock shaft holes 53 and auxiliary lock shaft holes 54 for main and auxiliary lock shafts 61 and 71 to run through.

Main lock 6 is a common conventional tubular, or lever handle lock has shaft 61 to combine with an inside and an outside knob or handle and to go through the dead bolt so that shaft 61 can pull in the dead bolt by its rotation. And main cam disc 62 is set on shaft 61, being rotated together with shaft 61. Main cam disc 62 has two protrusions at its two sides, said protrusions horizontal when main lock 6 is not rotated and possible to touch and urge lower hooks 22 of linking plate 2 when rotated.

Auxiliary lock 7 is also a common conventional auxiliary lock, having shaft 71 to pull in the dead bolt when it is rotated. Shaft 71 is flat and runs through a flat hole in shaft post 73 penetrating through shaft cover 74 and combines with turning button 75 at the inside of a door.

Shaft cover 74 is set in auxiliary lock shaft hole 12 in intermediate plate 1, and rotation of shaft 71 can cause rotation of shaft cover 74 or vice versa. Generally, the shaft of an auxiliary lock can be rotated by turning button 75. Shaft post 73 is provided with an oval portion to go through an oval hole in auxiliary cam disc 72 and then to be pinched by C-shaped ring 76 so as to fix said disc 72 on shaft post 73. Auxiliary cam disc 72 has two protrusions at its both sides, and said protrusions are horizontal and kept in contact with upper hooks 21 of linking plate 2 when auxiliary lock 7 is unlocked.

Figure 3:
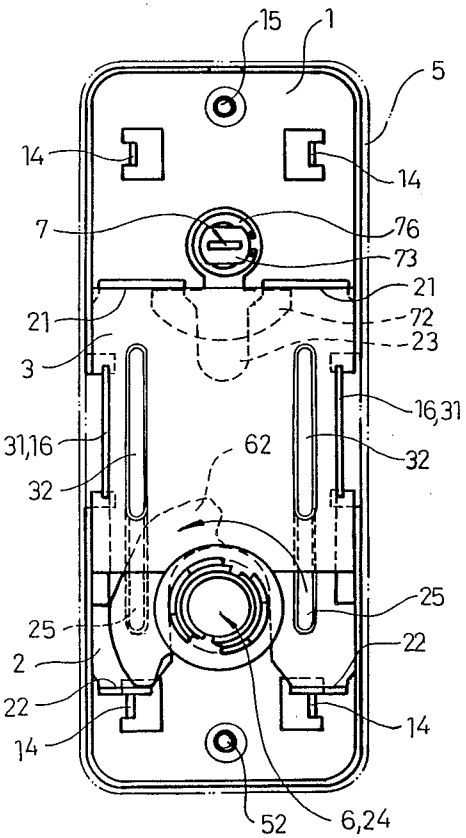
FIG. 3 is an elevational view of this invention in non-united position, with the main lock being rotated.
Figure 2:
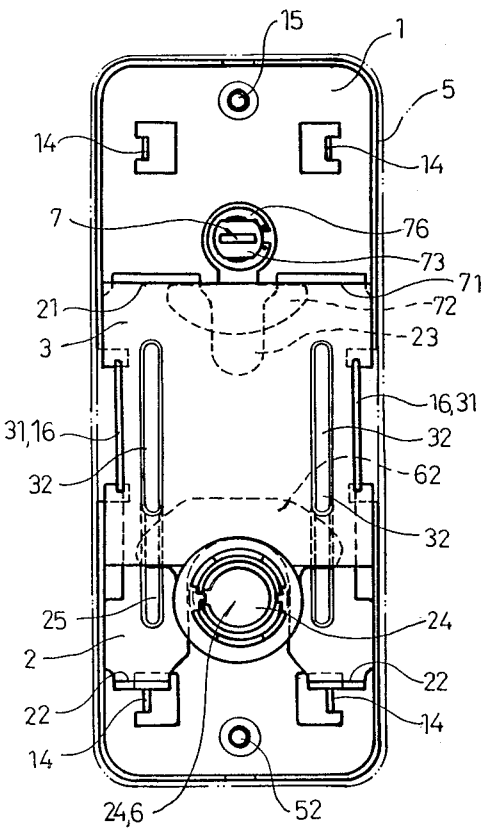
FIG. 2 is an elevational view of this invention in non-united position.

Now, referring to FIG. 2, when auxiliary lock 7 is unlocked with the door shut, two protrusions of auxiliary cam disc 72 keep in contact with the lower side of upper hooks 21 of linking plate 2, shaft 71 being horizontal, lower hooks 22 being in contact with the upper edges of lower feet 14, main cam disc 62 being horizontal and separated from lower hooks 22 because of normal position of main lock 6. Next, referring to FIG. 3, main lock 6 is rotated under unlocked position of auxiliary lock 7. If auxiliary lock 7 is rotated, main cam disc 62 will also be rotated, but said disc 62 does not come in contact with linking plate 2 until said disc 62 has rotated to its end point, so said disc 62 never directly move linking plate 2.

Figure 4:
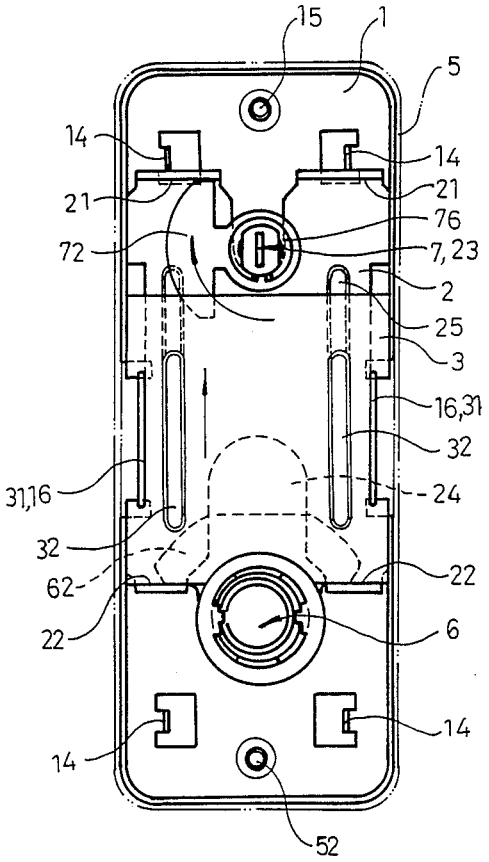
FIG. 4 is an elevational view of this invention in united opening position with the auxiliary lock rotated.

Referring to FIG. 4, if auxiliary lock 7 is rotated for 90°, shaft 71 activates the dead bolt to extend out to lock said lock 7, and then auxiliary cam disc 72 is also rotated as shown by the arrow head—actually said disc 72 can also turn counter-clockwise—linking plate being moved up by said disc 72 so that lower hooks 22 come to touch with two protrusions of main cam disc 62. And linking plate 2 cannot fall down of itself because of the structure of the dead bolt of auxiliary lock 7. Therefore, this position constitutes united opening function of the main and the auxiliary locks. Shaft 61 can drive main cam disc to rotate either clockwise or counter-clockwise, linking plate being pushed down with lower hooks 22 pushed down by two protrusions of main cam disc 62. When linking plate 2 falls down, upper hooks 21 push the protrusions of auxiliary cam disc 72, which then rotates to the position shown in FIGS. 2 and 3, that is, the dead bolt can be pulled in.

In short, according to this invention, linking plate 2 is in the lower position while auxiliary lock 7 is unlocked, and the protrusions of main cam disc 62 is not in contact with lower hooks 22 of linking plate 2 so that rotation of shaft 61 of main lock 6 never moves linking plate 2, which results in no mutual striking noise, and lessens breaking percentage of the whole lock accordingly.

What is claimed is:

1. An opening device for a double lock comprising:

an intermediate plate provided with a main lock shaft hole and an auxiliary lock shaft hole for main and auxiliary lock shaft hole for main and auxiliary lock shafts to run through, two pair of feed respectively at an upper and lower section of said plate for limiting vertical movement of a linking plate, and a hook base respectively at its both sides for guiding the linking plate to move vertically;

an H/shaped linking plate provided with two pair of inward bend hooks respectively at the top and the bottom, two straight recesses respectively at opposite sides of said linking plate to engage with the hook base of the intermediate plate and thereby the linking plate being restricted to move vertically;

a limit plate provided with a pair of straight recesses respectively on opposite sides for the hook base of the intermediate plate to protrude therein and thereby the limit plate being kept at a position such that the linking plate may be confined between the intermediate plate and the limit plate to move straight up and down;

a surface plate having bolt holds for combining with a bottom plate sandwiching the intermediate plate, the linking plate and the limit plate therebetween, and provided with a main lock shaft and an auxiliary lock shaft hole for main and auxiliary lock shaft to run through, and holes near the peripheries of said two shaft holes for bolts to go through in assembling main and auxiliary locks with the surface plate;

a bottom plate provided with bolt holes for bolts to screw with the bolt holes in the surface plate for combining the intermediate plate, the linking plate, and the limit plate between the bottom plate and the surface plate, and a main lock shaft hole and an auxiliary lock shaft hole for main and auxiliary lock shafts to run through;

a main lock provided with a shaft to run through the main lock shaft holes of the surface plate, the intermediate plate and the bottom plate, an inside an outside knob, a cam disc linked on and moved together with the shaft positioned between the surface plate and the linking plate and provided with a pair of protrusions respectively on opposite sides of cam disc for potential contact with the lower hooks of the linking plate;

an auxiliary lock having a shaft to run through the auxiliary lock shaft holes in the surface plate, the intermediate plate and the bottom plate, a shaft post fixed at the shaft end and possible to rotate inside a post cover and combined with a turning button, a cam disc fixed and rotated with the shaft, said cam disc of said auxiliary lock positioned between the surface plate and the linking plate and provided with a pair of protrusions respectively on opposite sides of said cam disc for potential contact with the upper hooks of the linking plate; and said auxiliary cam disc having its two protrusions in contact with the bottom sides of the upper hooks of the linking plate and said linking plate having its lower hooks separated from the protrusions of the main cam disc when the auxiliary lock is in unlocked position, one protrusion of the auxiliary cam disc being possible to push up the linking plate so that the lower hooks of the linking plate may come to contact with the protrusions of the main cam disc when the auxiliary lock is locked by rotating its shaft, one protrusion of the main cam disc possible to urge the lower hook of the linking plate to make the linking plate to move down so that the auxiliary cam disc may be forced to recover its original position pushed down by the upper hooks of the linking plate when the main lock is rotated.

2. The opening device for a double lock as claimed in claim 1, wherein said auxiliary cam disc has its two protrusions in horizontal position and in contact with the lower side of the upper hooks of the linking plate when the auxiliary lock is unlocked, and said auxiliary cam disc can push up the linking plate when the auxiliary lock is rotated in locking.

3. The opening device for a double lock as claimed in claim 1, wherein said linking plate is in the lower position, having its lower hooks down at the bottom surface of the intermediate plate when the auxiliary lock is unlocked, and the protrusions of the main cam disc is separated from the lower hooks of the linking plate when the main lock is not rotated.

* * * * *